US010066822B2

(12) United States Patent
Chen et al.

(10) Patent No.: US 10,066,822 B2
(45) Date of Patent: Sep. 4, 2018

(54) ELECTRONIC CONNECTOR DEVICE

(71) Applicant: LEEDARSON LIGHTING CO., LTD, Fujian (CN)

(72) Inventors: Xiaobo Chen, Xiamen (CN); Zhongming Fu, Xiamen (CN); Guijuan Song, Xiamen (CN); Maojin Zeng, Xiamen (CN); Jianghuai Li, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/508,489

(22) PCT Filed: Jul. 27, 2016

(86) PCT No.: PCT/CN2016/091859
§ 371 (c)(1),
(2) Date: Mar. 2, 2017

(87) PCT Pub. No.: WO2017/024940
PCT Pub. Date: Feb. 16, 2017

(65) Prior Publication Data

US 2017/0276339 A1 Sep. 28, 2017

(30) Foreign Application Priority Data

Aug. 11, 2015 (CN) ..... 2015 1 0486690

(51) Int. Cl.
*F21V 23/06* (2006.01)
*F21V 21/002* (2006.01)
*F21V 23/00* (2015.01)

(52) U.S. Cl.
CPC ..... *F21V 23/06* (2013.01); *F21V 21/002* (2013.01); *F21V 23/003* (2013.01)

(58) Field of Classification Search
CPC ..... H01R 4/4818; H01R 4/4827; H01R 4/48; H01R 4/4836; H01R 2103/00;
(Continued)

(56) References Cited

U.S. PATENT DOCUMENTS 3,915,544 A * 10/1975 Yurtin ..... H05K 3/326 439/747
4,640,561 A * 2/1987 George ..... H01R 12/592 439/77

(Continued)

*Primary Examiner* — Truc Nguyen
(74) *Attorney, Agent, or Firm* — Chun-Ming Shih

(57) ABSTRACT

An electronic connector device is used to connect the light source board and the driver board of the LED light electrically. One end of the input terminal is fixed on the light source board and connect to the light source board electrically. The other end of the input terminal is the elastic clip structure. When the light source board is relatively combined with the driver board and the diver board is set near the light source board, the other end of the input terminal connects on the output terminal elastically. In the present invention, the electronic connector device fixes the input terminal on the light source board and relates the input terminal on the output terminal elastically by setting the output terminal on the driver board surface. Efficiently simplifying the structure of the whole electrical connector to make the electronic connector device owns the advantage of the structure.

8 Claims, 4 Drawing Sheets

(58) Field of Classification Search
CPC ..... H01R 25/006; H01R 4/489; H01R 9/26; H01R 13/15; H01R 13/5833; H01R 13/652; H01R 4/26; H01R 4/52; H01R 12/515; H01R 12/58
See application file for complete search history.

(56) References Cited

U.S. PATENT DOCUMENTS

| | | | | |
|---|---|---|---|---|
| 6,089,880 | A * | 7/2000 | Miyagawa | H01R 13/11 439/741 |
| 6,911,602 | B2 * | 6/2005 | Conrad | H01R 9/2608 174/68.2 |
| 7,581,965 | B1 * | 9/2009 | Upasani | H05K 3/32 439/82 |
| 9,711,876 | B2 * | 7/2017 | Feye-Hohmann | H01R 4/4836 |
| 2015/0240998 | A1 * | 8/2015 | Reier | F21V 23/005 362/646 |
| 2015/0345766 | A1 * | 12/2015 | Wang | F21V 23/00 362/382 |
| 2015/0362168 | A1 * | 12/2015 | Power | F21K 9/23 362/294 |
| 2015/0380837 | A1 * | 12/2015 | Kollmann | H01R 4/4836 439/721 |

* cited by examiner

ELECTRONIC CONNECTOR DEVICE

TECHNICAL FIELD

The present invention is related to an LED lighting field and more particularly related to an electronic connector device.

BACKGROUND

An LED light source is used more and more widely, because the LED light source owns the advantages of high-efficiency lighting, low heating, power saving and long life time. The LED light gradually replaces the traditional lighting devices like an incandescent lamp and a halogen lamp. Nowadays, an LED bulb includes a light head, power supply board components, a lighting heat dissipation item and a lampshade. Between a light head and power supply board components; power supply board components and a lighting heat dissipation item all use the wire welding or use a screw press the wire directly to connect electrically. Because of the small space in the light device, the longer wire insert in the light device with messy is easy to make the phenomenon of the wire broken and the loosing wire welding.

Like the new type of the product for the licensing date on Sep. 25, 2013, the number of 201320131794.6 and the name of lighting diode bulb. A lighting diode bulb includes a light head. a light head includes a light inner sleeve, an electronic connection unit. The electronic conductive elastic clip is put in the light head inner sleeve. The electronic connection unit is combined under the light head inner sleeve. Through the electronic connection unit, the electricity conductive elastic clip and the electronic insert plug insert mutually to realize the electronic connection. The new type of the product uses the present technology of the commonly connected way by box and pin terminal to realize the electronic connection. The connected way needs to use the insert to realize the electronic connection, but the combination and the production process are all complicated. In order to adapt the use of need for the consumer, how to further simplify the structure, minimize the volume of the light head, and decrease the production cost are the main trend nowadays.

SUMMARY OF INVENTION

In view of this, it is necessary to provide the electronic connector device with a simple structure.

An electronic connector device is used to connect the light source board and the driver board of the LED light electrically. The electronic connector device includes input terminal and output terminal. The output terminal is a flake structure set on the surface of the driver board of the LED light. One end of the input terminal is fixed on the light source board and connect to the light source board electrically. The other end of the input terminal is the elastic clip structure. When the light source board is relatively combined with the driver board and the diver board is set near the light source board, the other end of the input terminal connects on the output terminal elastically.

Comparing with the existed technology, the electronic connector device fixes the input terminal on the light source board and relates the input terminal on the output terminal elastically by setting the output terminal on the driver board surface. Because the output terminal is directly set on the surface of the driver board. When the other end of the input terminal is related to the output terminal elastically, the driver board may support the output terminal to make sure the connection between the input terminal and output terminal. Because the input terminal is fixed by the driver board, the structure of the input terminal become easier. Efficiently Simplifying the structure of the whole electrical connector to make the electronic connector device owns the advantage of the simple structure.

DETAILED DESCRIPTION

Though the attached drawing and the embodiment to describe the present invention detailed in following statement.

The first embodiment of the present invention, the electronic connector device, please refer to FIG. 1 to FIG. 4.

Figure 1:
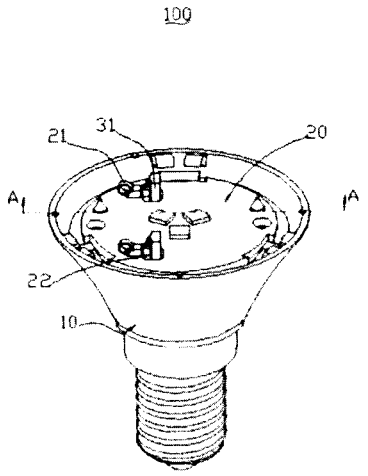
FIG. 1 is the first embodiment stereoscopic drawing for the present invention, the electronic connector device.
Figure 2:
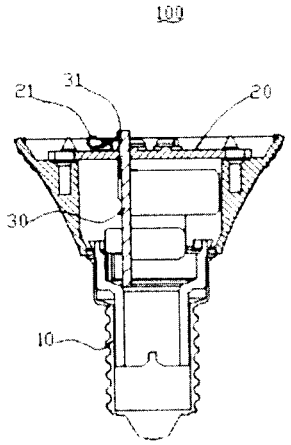
FIG. 2 is the sectional drawing from FIG. 1 that illustrates A-A line.

Please refer to FIG. 1 and FIG. 2, an electronic connector device is set in a light head (10). The light head (10) is the common combination of the LED shell and the screw light head, and surely may be another way of the light shell structure. The light head (10) is hollow shell structure, there is a light source board (20) and a driver board (30) in the light head (10). The electronic connector device is separately set on the light source board (20) and the driver board (30). The electronic connector device is used in the electrical connection of the light source board (20) and the driver board (30). The electronic connector device includes an input terminal (21) and an output terminal (31). The output terminal (31) is set on the surface of the flake structure of the LED driver board (30). One end of the input terminal (21) is fixed on the light source board (20) and related to the light source board (30) electrically. In the patent, "the output terminal (31) is set on the surface of the LED driver board (30)" means the output terminal (31) is fixed on the surface of the driver board through welding and riveting and connected with the driver board (30) to become a whole set.

The other end of the input terminal (21) is elastic clip structure (211). When the light source board (20) is combined with the driver board (30), the driver board (30) is set near the light source board (20). The other input terminal (21) is elastically related to the output terminal (31).

The output terminal (31) and the input terminal (21) are equal to an extremely tiny item. The output terminal (31) and the input terminal (21) are separately set on the driver board (30) and the light source board (20), may not occupy any space of the light head (10) and brings the important meaning in simplify and minimize the light head (10).

Please refer to FIG. 1 and FIG. 2, the driver board (30) is set below the light source board (20). The input terminal (21) is fixed on the top of the light source board (20). The perforation (22) is set on the light source board (20). The input terminal is set near the perforation (22). Of course, the input terminal (21) may be fixed on the bottom of the light source board (20).

Setting the elastic clip structure (211) on the other end of input terminal (21), and the elastic clip structure (211) may conveniently weld on the light source board (20) and simplify the production process.

Figure 3:
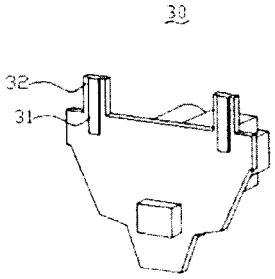
FIG. 3 is the stereoscopic drawing from FIG. 1 that illustrates the driver board for the electronic connector device.
Figure 4:
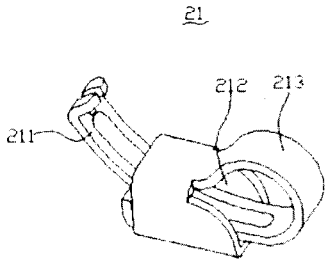
FIG. 4 is the stereoscopic drawing from FIG. 1 that illustrates the input terminal of the electronic connector device.

Please refer to FIG. 1, FIG. 2, and FIG. 3, the supporting portion (32) is set on the driver board (30). The supporting board (32) is set near the light source board (20). The output terminal (31) is set on the side of the supporting portion (32). The supporting portion (32) is the extend upwards column structure. (As the FIG. 1 and FIG. 2 illustrates) The supporting portion (32) insert the perforation (22). In priority, the output terminal (31) is the slice copper foil welded on the supporting portion (32) of the driver board (30). Only need to weld on the supporting portion (32) or set a slice of copper foil or a metal electricity conductive slice to make the output terminal (31). Do not need to set the connector or terminal, this simplify the structure and decrease the production cost.

please refer to FIG. 1, FIG. 2 and FIG. 4, the input terminal (21) is made of the metal ingredient bent whole set. One of the input terminal (21) is the ring structure (213) with the through hole. The bottom of the ring structure (213) is fixed on the light source board. The ring structure (213) is set interval with the supporting portion (32) and one side of the through hole (212) is set toward the supporting portion (32). The elastic clip structure (211) is related to the other side of the through hole (212). The elastic clip structure (211) is bent then passes through the through hole (212) and connects the terminal (21) through the through hole (212).

Setting the ring structure (213) is to rise the elasticity of the input terminal (21) and to make the other end of the elastic clip structure (211) may be stably related on the output terminal (31) to own the stable electricity connection. The function of the through hole (212) is to limit the site for the elastic clip structure (211) to avoid the elastic clip structure (211) to be upward or downward deformation and may not provide the power of elastic relation when relates to the input terminal (21). By the through hole (212) may make the whole input terminal (21) structure stable. Adapting the batch production to ensure the stable structure of the electronic connector device.

In priority, the other end of the input terminal (21) tilts away toward the light source board (20). The elastic clip structure (211) sets the strong gluten on the other side of the through hole (212). The through hole (212) is the column structure. The elastic clip structure (211) is related to the input terminal through the one side of the through hole (212) and the on side of the through hole (212) at the same time.

When the electronic connector device works, setting the driver board (30) in the light head (10) and setting the light source board (20) on the top of the light head (10). The supporting portion may be the electricity connection with the elastic clip structure (211) of the input terminal (21) through the perforation (22) on the light source board (20). Simplify the whole structure and make the stable electricity connection between the driver board (30) and the light source board (20). The cost of the electronic connector is low. The product combination is simple.

In conclusion, through setting the input terminal (21) to become the elastic clip structure (211) to set on the light source board (20) conveniently. The electronic connector owns the advantages of the simple structure, small volume and low cost. The output terminal (31) set a metal electricity conductive layer on the supporting portion (32) upward of the driver board (30). Deleting the structure of terminal and connector in nowadays technology simplify the whole structure. Because the output terminal is set directly on the surface of the driver board, when the other end of the input terminal elastically is related on the output terminal, the driver board may support the output terminal to ensure the electrical connection between the input terminal and the output terminal. Because the input terminal is fixed on the driver board, the structure of the input terminal become easier, and may efficiently simplify the whole structure of the electronic connector. The electronic connector owns the advantage of simple structure. To see nowadays technology, because the input terminal is not fixed on the light head (10) directly, and need other assistant method to realize the fix of the input terminal. For example, setting two elastic clips to make the input terminal set between two elastic clips makes the complication of the structure.

The statement above just for the better embodiment, not for limiting the present invention. All the modification, equal to any change and improvement that are based on the present invention's spirit and principle, may be protected in the present invention protection range.

The invention claimed is:

1. An electronic connector device used to connect a light source board and a driver board of a LED light electrically, the electronic connector device comprising:

an input terminal; and an output terminal, wherein the output terminal is a flake structure setting on a surface of the driver board of the LED light; one end of the input terminal is fixed on the light source board and connected to the light source board electrically; the other end of the input terminal comprises an elastic clip structure extended from a ring structure through a though hole, the elastic clip structure and the ring structure are made of a metal piece by bending the metal piece and opening the through hole on the metal piece, the ring structure provides an elastic force for the elastic clip structure; when the light source board is combined with the driver board the elastic clip structure of said other end of the input terminal engages the output terminal elastically to form electricity connection.

2. The electronic connector device of claim 1, wherein a supporting portion is set on the driver board; the supporting board is set near the light source board; the output terminal is set on the side of the supporting portion.

3. The electronic connector device of claim 1, wherein the driver board is set below the light source board; the input terminal is fixed on the top of the light source board; a perforation is set on the light source board; the input terminal is set near the perforation; the output terminal is set on the side of the supporting portion; the other end of the input terminal is bent toward the direction near the light source board.

4. The electronic connector device of claim 2, wherein the perforation is set on the light source board; the supporting portion is a column structure; the supporting portion insert the perforation; the insert terminal is set near the perforation.

5. The electronic connector device of claim 4, wherein the driver board is set under the light source board; the input terminal is fixed on the top of the light source board.

6. The electronic connector device of claim 5, wherein the other end of the input terminal tilts away toward the light source board.

7. The electronic connector device of claim 1, wherein the bottom of the ring structure is fixed on the light source board; the ring structure and the elastic clip structure are located at two sides of the through hole.

8. The electronic connector device of claim 7, wherein the elastic clip structure sets the strong connection on the other side of the through hole.

* * * * *